US006755398B1

(12) United States Patent
Wong

(10) Patent No.: US 6,755,398 B1
(45) Date of Patent: Jun. 29, 2004

(54) HEATED WATER MIST THERAPY APPLIANCE

(75) Inventor: Ying Man John Wong, Shatin N.T. (CN)

(73) Assignee: Raymond Electric (China) Ltd., Shatin (HK)

( * ) Notice: Subject to any disclaimer, the term of this patent is extended or adjusted under 35 U.S.C. 154(b) by 0 days.

(21) Appl. No.: 10/280,202

(22) Filed: Oct. 25, 2002

(51) Int. Cl.[7] ..... B01F 3/04

(52) U.S. Cl. ..... 261/81; 4/574.1; 261/127; 261/130; 261/DIG. 48; 261/DIG. 65

(58) Field of Search ..... 261/81, 1, 127, 261/142, DIG. 48, DIG. 65, 129, 130; 4/574.1

(56) References Cited

U.S. PATENT DOCUMENTS

| | | | | | |
|---|---|---|---|---|---|
| 4,599,997 | A | * | 7/1986 | Bucher | 601/65 |
| 4,752,423 | A | * | 6/1988 | Wong | 261/142 |
| 4,776,990 | A | * | 10/1988 | Verity | 261/128 |
| 5,010,905 | A | * | 4/1991 | Snyder et al. | 132/272 |
| 5,464,572 | A | * | 11/1995 | Bonzi | 261/30 |
| 5,792,241 | A | * | 8/1998 | Browitt | 96/52 |
| 5,918,804 | A | * | 7/1999 | Jung | 236/44 A |
| 6,226,451 | B1 | * | 5/2001 | Wong | 392/405 |
| 6,465,760 | B1 | * | 10/2002 | Wong | 219/398 |
| 6,499,195 | B1 | * | 12/2002 | Wong | 219/222 |
| 6,592,107 | B1 | * | 7/2003 | Wong | 261/142 |
| 2003/0042629 | A1 | * | 3/2003 | Eom | 261/81 |

FOREIGN PATENT DOCUMENTS

| | | | | |
|---|---|---|---|---|
| JP | 54-56236 | * | 5/1979 | 261/DIG. 48 |

* cited by examiner

*Primary Examiner*—Richard L. Chiesa
(74) *Attorney, Agent, or Firm*—Alix, Yale & Ristas, LLP

(57) ABSTRACT

A heated water mist therapy appliance generates temperature controlled therapeutic mist by applying ultrasonic vibration to temperature controlled (heated) water. The resulting heated water mist may be applied to the skin of the feet or diverted into a flexible conduit for application to other parts of the body. In some embodiments of the appliance, the user may control the temperature of the water used to make the mist, thereby controlling the temperature of the therapy. The user also controls the volume of water mist/air mixture by adjusting the speed of a fan. The appliance may include an ionizing electrode to enhance the ionic content of the water mist/air mixture.

14 Claims, 7 Drawing Sheets

HEATED WATER MIST THERAPY APPLIANCE

BACKGROUND OF THE INVENTION

1. Field of the Invention

This invention relates generally to appliances for soothing external treatments to the body, and more particularly to an appliance for therapeutic treatment of various body parts with heated water mist.

2. Field of the Related Art

Numerous therapy appliances that apply external treatments to the body are known in the art. Among the parts of the body to which therapeutic treatments are directed are the feet and the skin. One large category of foot treatment appliance involves bathing the feet in warm water that is circulated to perform a massaging function on the feet. This circulation may be accomplished by use of bubbles sent through the water. Alternatively, the foot treatment appliance may be a dry appliance in which air and/or mechanical devices are used to massage the feet. The pressure points may be mechanically driven. The pressure points may also include a vibration feature.

Some prior art water mist treatment appliances attempt to use "live" steam generated by boiling water. The resultant steam vapor is extremely hot, making control of the temperature of the steam output quite difficult and presenting the danger of burn hazards to the user. Further, steam produced from a boiling reservoir of water is typically emitted in a pulsing manner making control of the volume emitted difficult. Adjustment of the output temperature for various user preferences has also been difficult. In addition, once live steam has been cooled, it typically takes the form of warm, moist air, e.g., it lacks sufficient vapor to appear as steam to the user.

SUMMARY OF THE INVENTION

These and other deficiencies of the prior art are overcome in the present invention. A heated water mist therapy appliance embodying several aspects of the present invention uses an ultrasonic transducer to produce a fine water mist without the need for boiling and thus avoiding the dangers and control difficulties presented by "live" steam. A heating element provides a source of hot water and a mixing valve controls the temperature of water from which the mist is produced. The user can also control the volume of warm mist directed at the body by adjusting the speed of a fan. In accordance with a further aspect of the present invention, an air stream mixed with the water mist may be ionized to increase the therapeutic value of the heated water mist treatment. In accordance with a yet further aspect of the present invention, an alternative configuration of the appliance may be provided with a mist outlet connected to a flexible hose that permits ionized warm mist to be directed at body parts other than the feet.

An object of the present invention is to provide a new and improved heated water mist therapy appliance in which the feet are massaged by heated water mist without boiling water or creating live steam.

Another object of the present invention is to provide a new and improved heated water mist therapy appliance in which the feet are treated with warm water mist, the temperature and volume of which can be controlled by the user.

A further object of the present invention is to provide a new and improved heated water mist therapy appliance in which ionized air may be mixed with the heated water mist.

A yet further object of the present invention is to provide a new and improved heated water mist therapy appliance in which the output of heated, optionally ionized water mist may be directed through a flexible conduit for use in conjunction with any part of the body.

BRIEF DESCRIPTION OF THE DRAWINGS

These and other objects, features and advantages of the invention will become readily apparent to those skilled in the art upon reading the description of the preferred embodiments, in conjunction with the accompanying drawings, in which.

DETAILED DESCRIPTION OF THE PREFERRED EMBODIMENTS

Figure 1:
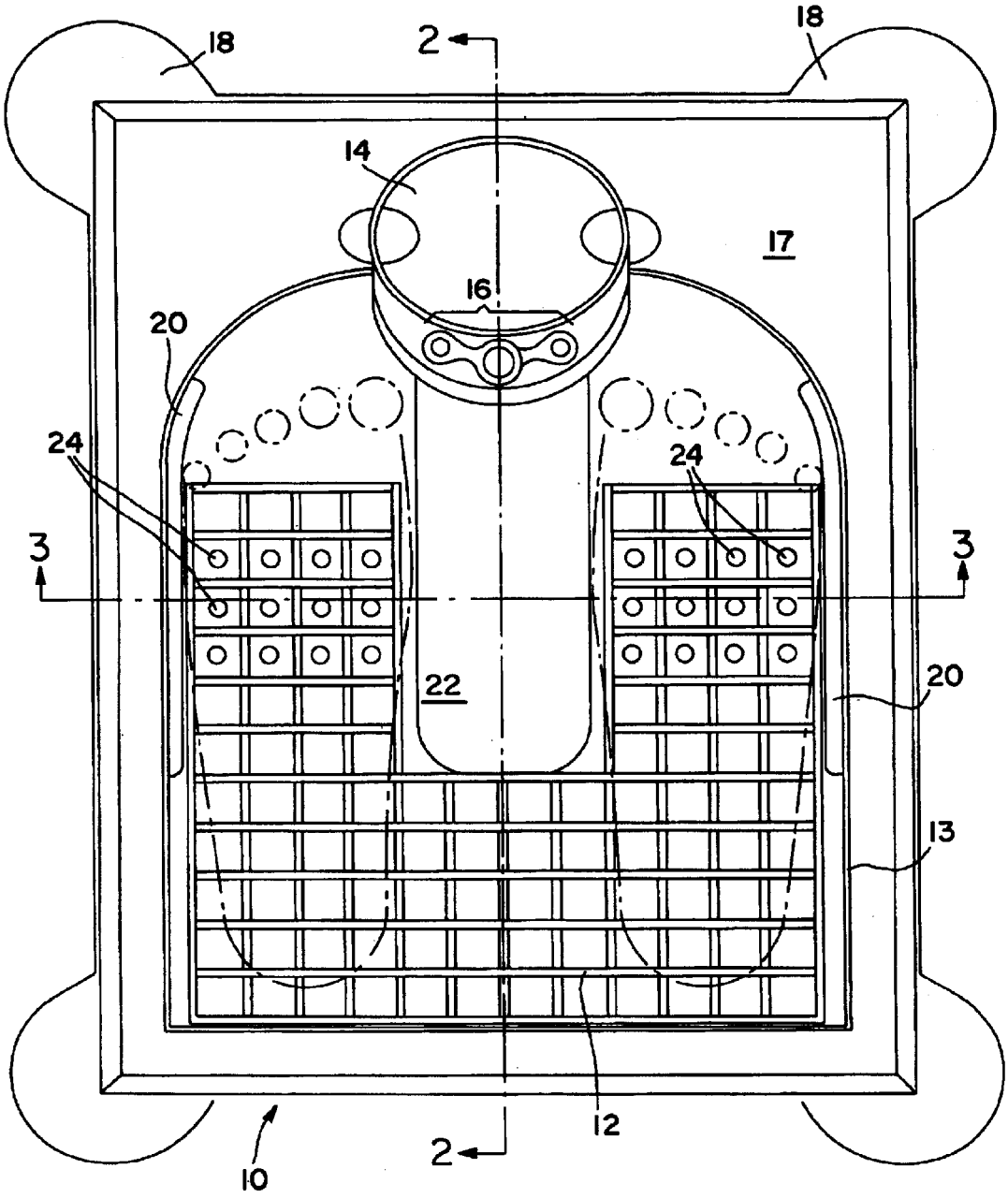
FIG. 1 is a top plan view of an exemplary embodiment of a heated water mist therapy appliance in accordance with several aspects of the present invention.
Figure 2:
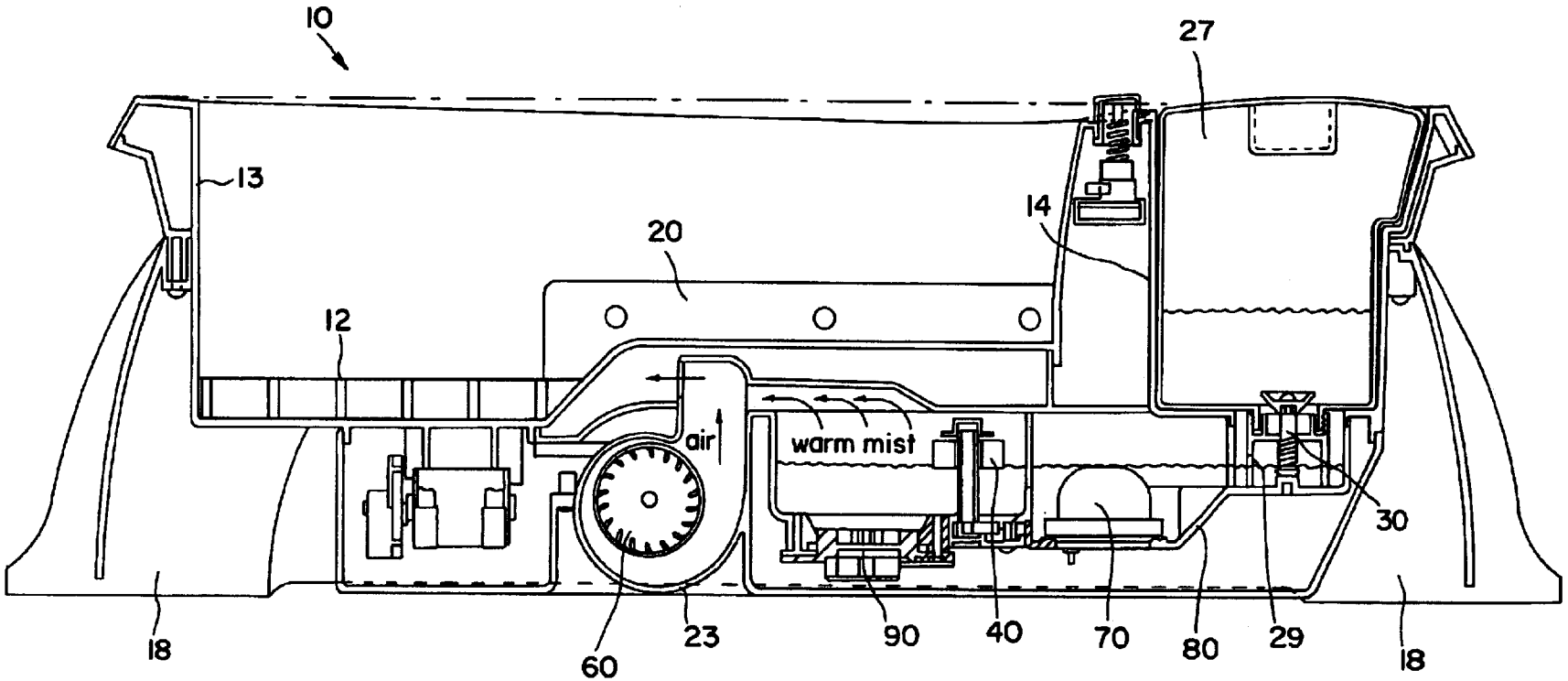
FIG. 2 is a side sectional view through the appliance of FIG. 1 taken along line 2—2 thereof.
Figure 3:
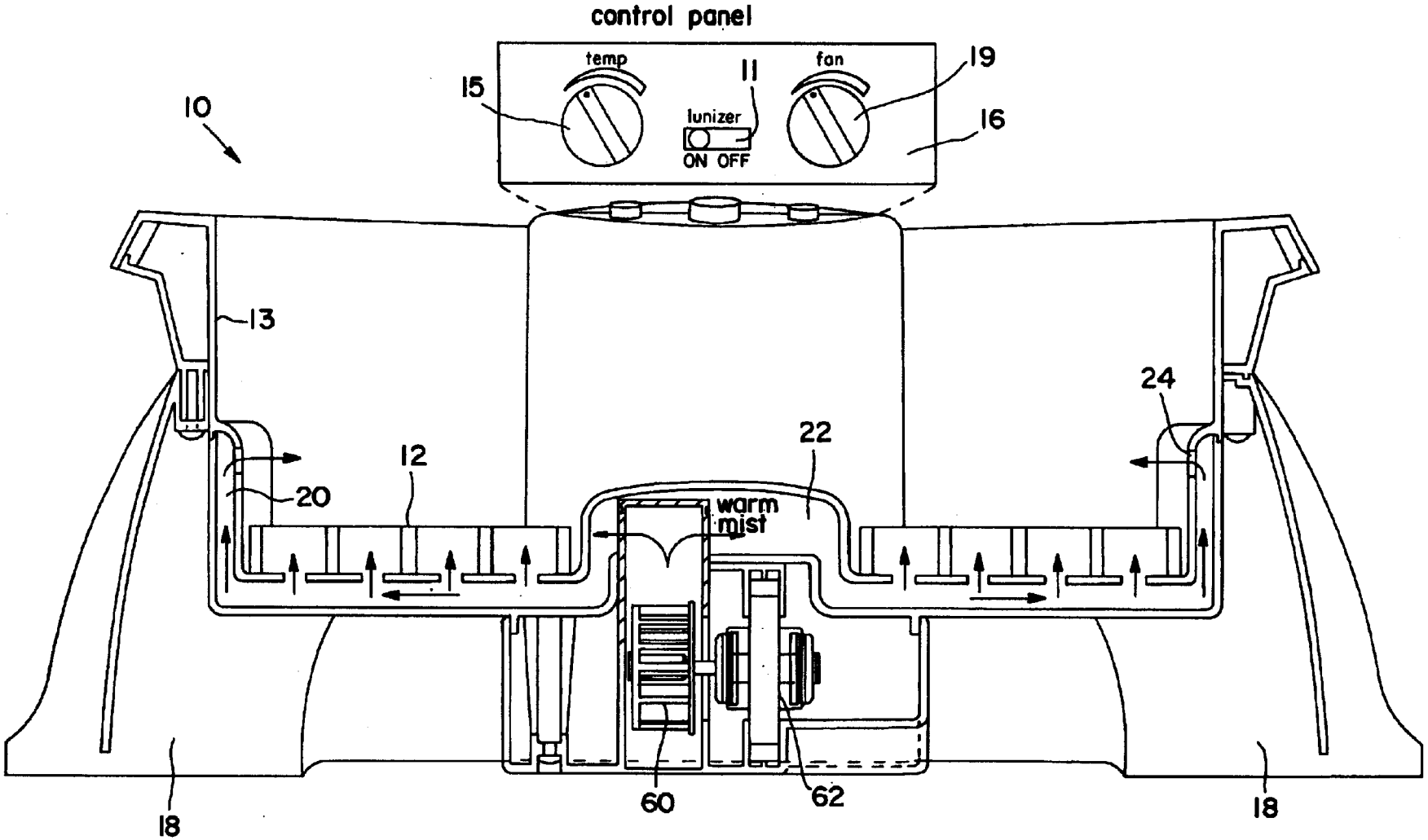
FIG. 3 is a lateral sectional view through the appliance of FIG. 1 taken along line 3—3 thereof.

A first exemplary embodiment of a heated water mist treatment appliance in accordance with several aspects of the present invention will now be described with reference to FIGS. 1–4A FIG. 1 is an overhead plan view of a first exemplary embodiment of a heated water mist treatment appliance 10 (hereinafter "appliance") in accordance with several aspects of the present invention. The appliance 10 is supported on a base 17 having diagonally projecting feet 18 to improve stability. Atop the base 17, a substantially vertical wall 13 surrounds a foot well having a bottom in the form of a grate 12. A water reservoir receptacle 14 receives a removable water reservoir 27. A control panel 16 including three control buttons 11, 15, 19 is positioned on the water reservoir receptacle 14 facing the user. With reference to FIG. 2, the water reservoir 27 is in the form of a removable container such that the container may be brought to a source of water, filled and placed in the receptacle 14. A valve 30 is spring biased toward a closed position. When the water reservoir 27 is removed from the foot sauna 10, valve 30 automatically closes. The valve 30 is opened again when the full reservoir 27 is placed in the receptacle 14, as shown in FIG. 2.

A level control passage 29 controls flow of water from the reservoir 27 into the appliance 10 to maintain a constant fluid level. A sensor 40 detects the fluid level and, as a safety precaution, should the fluid level fall below a pre-established level, the sensor 40 is connected to a device that switches off the appliance 10 or at least removes power from the internal components. The sensor 40 may also be connected to warning lights and/or sound producing devices indicating the need to fill the water reservoir 27.

Figure 4:
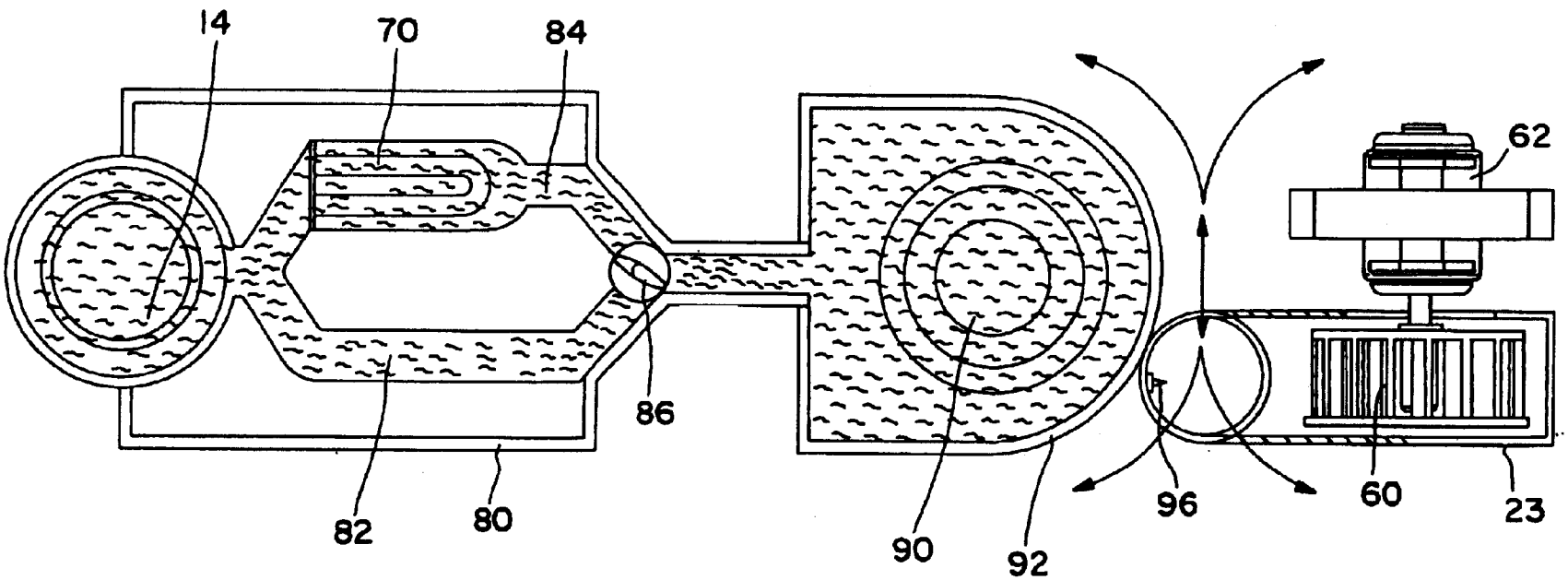
FIG. 4 is a functional diagram of the water temperature control, mist generation, ionization and mist distribution system for a heated water mist therapy appliance embodying several aspects of the present invention.

Water flows from the reservoir 27 into a water heating and mist production system illustrated in FIGS. 4 (adjustable temperature) and 4A (fixed temperature). In FIG. 4, water from the reservoir 27 first flows into a channeled member 80, having a hot channel 84 and a cool channel 82. A heater 70 positioned in the hot channel 84 heats water therein to a temperature of approximately 60° C. The cool channel 82 has no heater. A manually operated mixing valve 86 at the confluence of the hot channel 84 and cool channel 82 mixes hot and unheated water to arrive at a temperature selected by the user.

Temperature-adjusted water flows from the mixing valve 86 to a vaporizer chamber 92 in which is positioned an ultrasonic transducer 90. The ultrasonic transducer produces an ultrasonic vibration in the range of about 1.5 to 2 MHz. As is known in the art, this range of ultrasonic vibration causes water mist to be generated. The mist generated is substantially the same temperature as the water from which it is generated. A fan 60 driven by a motor 62 forces an air stream up a conduit past an opening where the heated water mist is drawn into the conduit by a venturi effect and mixes with the air stream. The fan 60 is positioned in a cowling 23 to gather outside air and force the outside air stream into a manifold best seen in FIG. 3 where the air stream and the water mist are mixed. The water mist/air mixture is ducted to side chambers 20 where the water mist is directed at the feet through openings 24.

The appliance 10 also provides for ionization of the water mist/air mixture. A negatively charged ionization electrode 96 is positioned in the cowling 23 to ionize the incoming outside air. This position of the ionization electrode 96 avoids many of the known negative effects of ionizing water vapor, e.g., the production of ozone. Ionized air is mixed with the water mist to provide an ion rich, heated water mist for therapeutic purposes. The technical features of the electronic circuitry and ionization electrodes need not be further discussed herein because such circuitry is well understood by those of skill in the art.

Figure 4A:
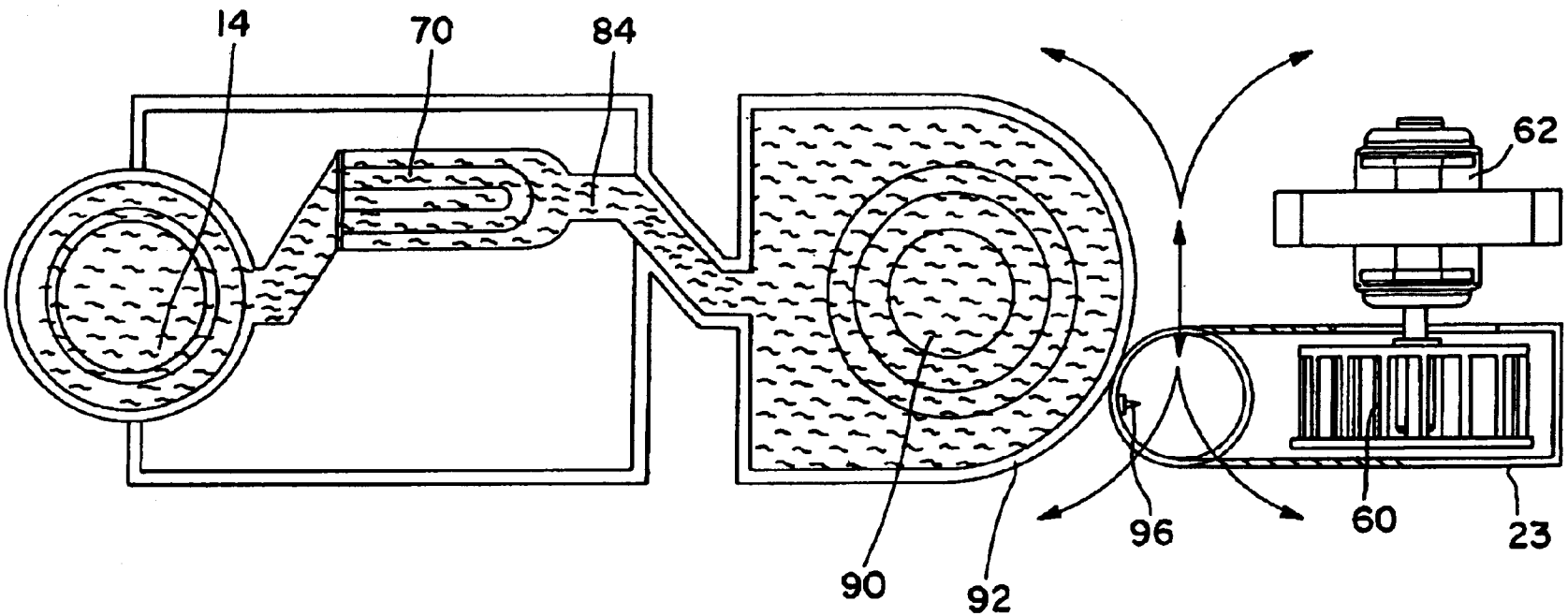
FIG. 4A is a functional diagram illustrating an alternative embodiment of a water temperature control, mist generation, ionization and mist distribution for a heated water mist therapy appliance embodying several aspects of the present invention.

FIG. 4A illustrates a simplified version of the water heating, mist generation and mist distribution system. The system illustrated in FIG. 4A lacks the cold water channel and mixing valve and is therefore not temperature adjustable. The heater 70 is thermostatically controlled to heat the water in the appliance to a pre-established temperature such as approximately 60° C.

Figure 5C:
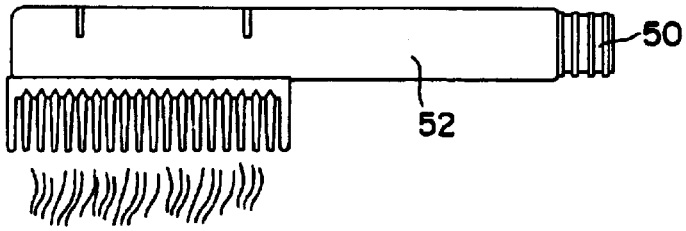
FIG. 5C illustrates an alternative nozzle for use in conjunction with the appliance of FIG. 5.
Figure 5:
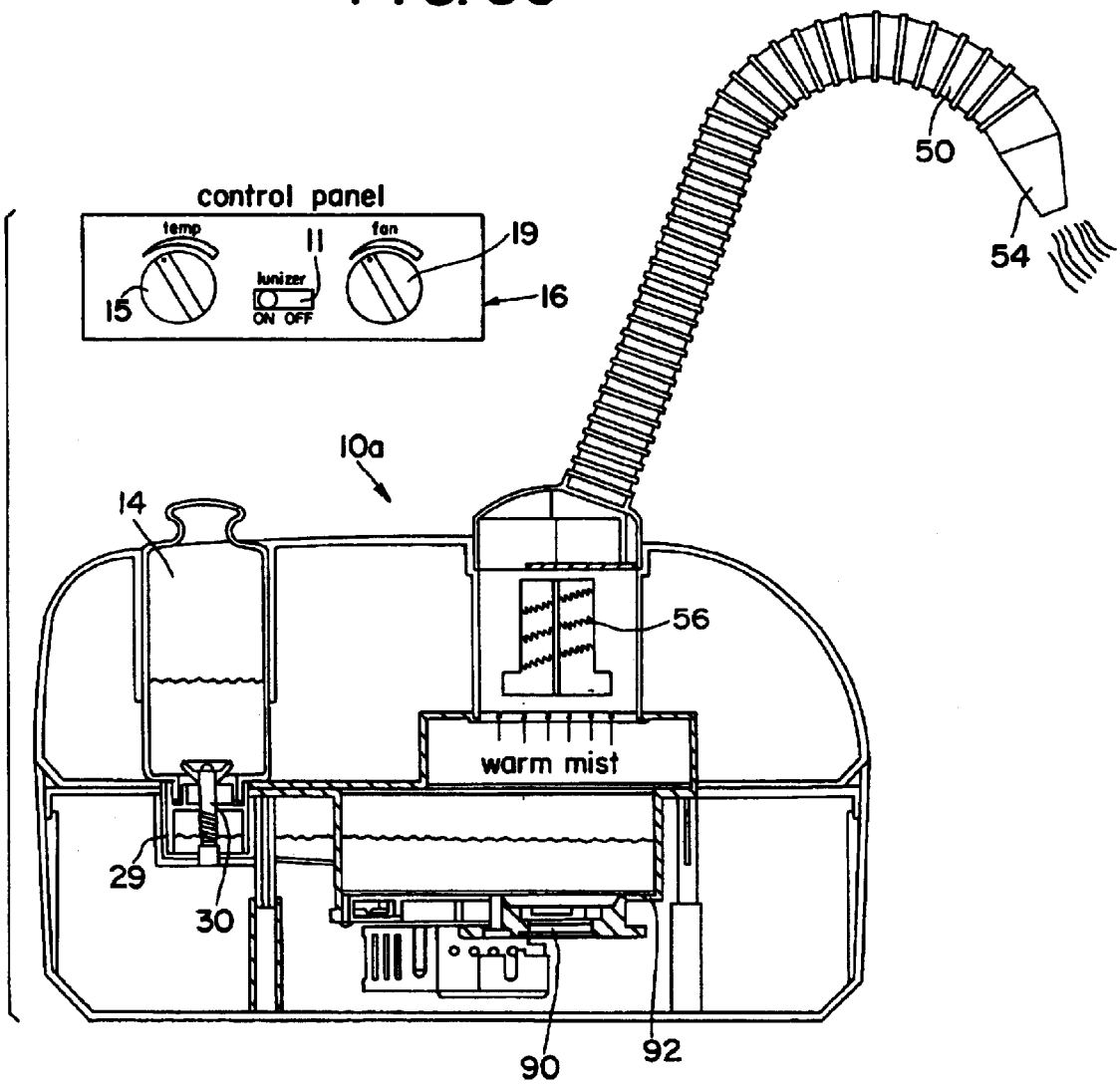
FIG. 5 is a sectional view through an alternative embodiment of a heated water mist treatment appliance in accordance with a further aspect of the present invention.

FIGS. 5 and 5A–5C illustrate an alternative embodiment 10*a* of a heated water mist therapy appliance in which the heated water mist is directed into a flexible hose 50 for application to any part of the body. The embodiment of FIG. 5 illustrates a heater 56 positioned to heat air passing into the hose 50. The heater 56 may be arranged anywhere in the blower duct/hose area, but is preferably positioned near the ionizer electrode 96 (see FIGS. 5A and 5B) and upstream from entry of water mist to avoid problems of corrosion and short circuits from water vapor condensing on the heater. The embodiment of FIG. 5 is preferably provided with controls that allow alternative selection of water vapor, ionized air, ionized/water vapor, dry air or heated dry air.

Figure 5A:
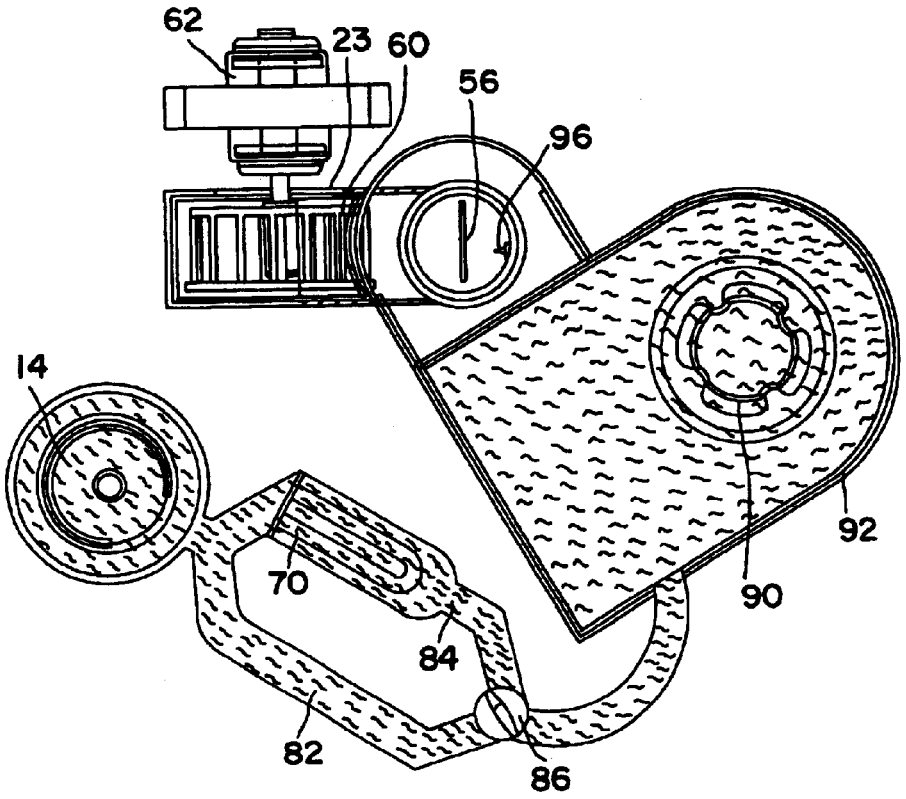
FIG. 5A is a functional diagram of a water temperature control, mist generation, ionization and mist distribution system for the appliance shown in FIG. 5.
Figure 5B:
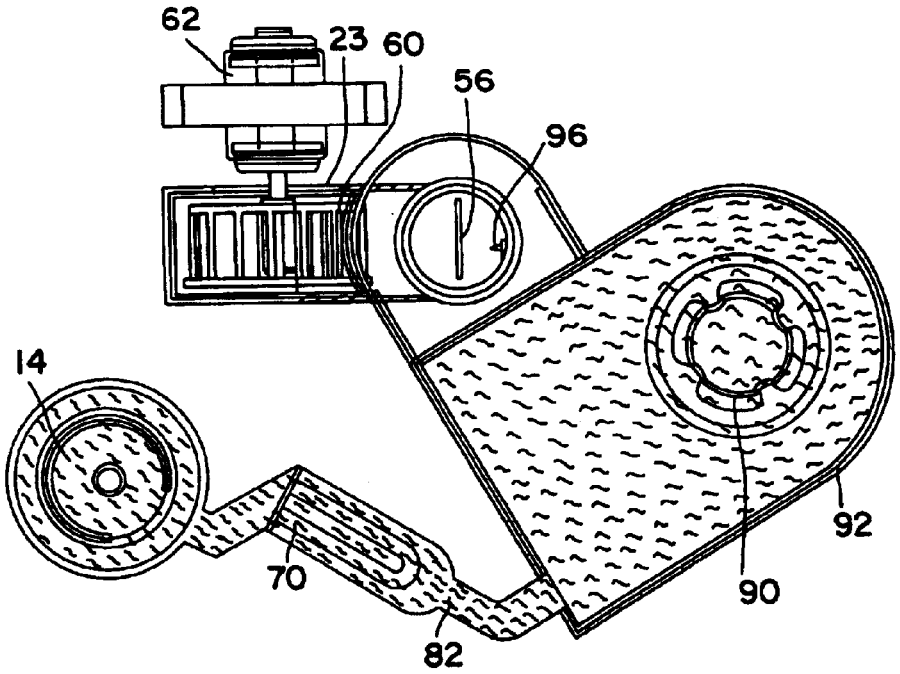
FIG. 5B is a functional diagram of an alternative water temperature control, mist generation, ionization and mist distribution system for the appliance shown in FIG. 5.

Those of skill in the art will recognize that the hose 50 may be terminated in any number of nozzles such as 54. In particular, FIG. 5C illustrates an alternative to nozzle 54 shown in FIG. 5. The nozzle 52 of FIG. 5C takes the form of a styling comb or brush for application of the warm mist to the hair. Other than this change in the application of heated water mist to the body, the embodiment of FIG. 5 operates on the same principles as the embodiments illustrated in FIGS. 1–4. FIG. 5A illustrates the water heating, water temperature control, mist generation and mist distribution system of the appliance 5A. The system of FIG. 5A operates in the same manner as the system shown in FIG. 4. FIG. 5B illustrates a fixed temperature water heating, mist generation and mist distribution system for embodiment 10*a* of the appliance.

Each of the illustrated examples of the appliance includes a control panel 16 from which the user may control the temperature and volume of the heated water mist applied to the body. The volume of heated water mist is adjusted using switch 19 to control the speed of the motor 62 driving the fan 60. On/off switch 11 allows a user to ionize or not ionize the flow of heated water mist directed at the body. Control knob 15 may be mechanically connected to the mixing valve 86 to control the temperature of water flowing to the mist generation chamber 92.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A heated water mist therapy appliance comprising:

a foot well supported on a base;

ducts communicating with the foot well through vents;

a manifold in communication with the ducts;

a fan arranged to draw ambient air into the manifold, said fan driven by a motor having an adjustable speed;

a water reservoir;

a heater arranged to provide a flow of water from said reservoir to a pre-established temperature; and a vaporizing chamber receiving said flow of water and including an ultrasonic transducer energized to produce ultrasonic vibrations to force evaporation of water in said output to form a water mist, said vaporizing chamber in communication with said manifold, wherein air driven by said fan draws water mist from said vaporizing chamber into said manifold to mix with said air to form a water mist/air mixture, said mixture flowing through said ducts and said vents into said foot well.

2. The appliance of claim 1, wherein said heater comprises a water heating system receiving water from the water reservoir, said water heating system comprising:

a first channel including a heater for heating water therein to a pre-established temperature;

a second channel having no heater; and a mixing valve at a confluence of the first and second channels for producing an output flow of water having a temperature in the range between room temperature and said pre-established temperature by mixing water from said first and second channels in accordance with a user input.

3. The appliance of claim 1, comprising an ionizing electrode selectively energizable to ionize the ambient air drawn into the manifold by said fan.

4. The appliance of claim 1, comprising a control panel permitting a user to selectively adjust the temperature of the output and the speed of the fan.

5. The appliance of claim 3, comprising a control panel permitting a user to selectively adjust the temperature of the output, the speed of the fan and energization of the ionizing electrode.

6. The appliance of claim 1, comprising a flexible conduit in communication with said manifold, and means for diverting flow of said mixture from said ducts to said conduit.

7. A heated water mist therapy appliance comprising:

a source of temperature controlled water;

a vaporization chamber arranged to receive the temperature controlled water, said chamber including an ultrasonic transducer energized to produce ultrasonic vibrations that produce a water mist from said temperature controlled water;

a manifold in fluid communication with said vaporization chamber;

at least one vent in fluid communication with said manifold;

a fan for moving the water mist from the vaporization chamber, through the manifold and vent; and a foot well configured to receive the feet of a user, wherein the at least one vent directs the water mist into the foot well.

8. The appliance of claim 7, wherein the fan draws ambient air into the manifold to mix with said water mist to form a mist/air mixture.

9. The appliance of claim 7, wherein the speed of said fan and the temperature of said water are adjustable by a user.

10. The appliance of claim 7, comprising an ionizing electrode selectively energizable to ionize the ambient air and positioned such that said ionization takes place prior to formation of said mixture.

11. The appliance of claim 10, wherein the speed of said fan and the temperature of said water are adjustable by a user and comprising a control panel permitting a user to selectively adjust the temperature of the output, the speed of the fan and energization of the ionizing electrode.

12. The appliance of claim 7, comprising a flexible conduit in communication with said at least one vent.

13. The appliance of claim 12, wherein said flexible conduit terminates in a nozzle in the form of a hair styling comb or brush.

14. The appliance of claim 12, comprising a heater arranged to heat air passing into said flexible conduit.

* * * * *